US007258509B2

(12) United States Patent
Ellwitz

(10) Patent No.: US 7,258,509 B2
(45) Date of Patent: Aug. 21, 2007

(54) DIVING APPARATUS

(76) Inventor: Martin Ellwitz, Galenstrasse 41, Witten (DE) 58452

( * ) Notice: Subject to any disclaimer, the term of this patent is extended or adjusted under 35 U.S.C. 154(b) by 0 days.

(21) Appl. No.: 10/450,332

(22) PCT Filed: Dec. 22, 2001

(86) PCT No.: PCT/DE01/04844

§ 371 (c)(1),
(2), (4) Date: Jun. 12, 2003

(87) PCT Pub. No.: WO02/051701

PCT Pub. Date: Jul. 4, 2002

(65) Prior Publication Data

US 2004/0052585 A1 Mar. 18, 2004

(30) Foreign Application Priority Data

Dec. 23, 2000 (DE) ..... 100 64 852

(51) Int. Cl.
*B63C 11/20* (2006.01)

(52) U.S. Cl. ..... 405/186; 405/194

(58) Field of Classification Search ..... 405/185–187
See application file for complete search history.

(56) References Cited

U.S. PATENT DOCUMENTS 3,050,055 A * 8/1962 Vautin ..... 128/205.18
5,092,327 A * 3/1992 Tragatschnig ..... 128/205.13
5,957,079 A * 9/1999 Wessels ..... 114/315
6,530,725 B1 * 3/2003 Courtney et al. ..... 405/186

* cited by examiner

*Primary Examiner*—Tara L. Mayo
(74) *Attorney, Agent, or Firm*—Jordan and Hamburg LLP

(57) ABSTRACT

A diving apparatus includes a pump that is actuated by muscular force. Diving weights are fastened to a fresh-air tank by surface zip fasteners. A traction element lies between the pump and the diver's limbs and to which it is attached a quick-release device. A float is surrounded by a net, the float having a seat located below the surface of the water and each of the straps, which are used to fasten the fresh-air tank to the diver, has at least one quick fastener which can be opened by the diver.

16 Claims, 12 Drawing Sheets

DIVING APPARATUS

BACKGROUND OF THE INVENTION

The invention relates to a diving apparatus for supplying a diver with breathing air, having a float on which a fresh air line leading from the air atmosphere to the diver is fitted, having a pump which is to be actuated by muscular force and by means of which the diver conveys fresh air via the fresh air line into a fresh air tank which can be worn and fastened on the body of the diver, having a first valve in the fresh air line between the fresh air tank and the air atmosphere, which prevents backflow of the fresh air into the air atmosphere, having a breathing air line which is connected with one end to the fresh air tank, having a mouthpiece which is arranged at the other end of the breathing air line, having a second valve, which is arranged on the breathing air line between the fresh air tank and the mouthpiece, having at least one pulling means, which is actuated at least with a leg or arm and permits the actuation of the pump by the leg or arm movement, and having diving weights which serve to compensate the buoyancy.

Diving apparatuses of this type have already been disclosed in European Patent Application EP 0 297 416. Diving apparatuses of this type are used now and then by sport divers. However, experience has shown that such equipment can give rise to a risk not to be underestimated, particularly for the inexperienced user. Since the diver cannot move in the water independently with such equipment, but always has to be connected via a fresh air line to a float located on the water surface, the likelihood of failure of the vital system components is relatively high. Unforeseeable circumstances such as, for example, kinking of the fresh air line harbor a multiplicity of risks. Consequently, increased safety requirements are to be placed on diving apparatuses of the type mentioned at the beginning.

In the case of diving apparatuses as already known in the prior art, cutting off the fresh air supply can have fatal consequences even at a shallow diving depth. The diver, who is generally neutrally buoyant at a specific depth, first registers the cutting off of the fresh air supply when attempting to breath in after breathing out has already been performed. If it is no longer possible at this instant to breath in, the diver lacks the buoyancy from the breathing air and begins to sink, in particular when the fresh air tank is already filled with water. Such a not unlikely situation is heightened by any amounts of water possibly sucked into the lungs. The average user easily panics in such a dangerous situation because he is greatly circumscribed in his freedom of movement owing to the pulling means and apparatuses fitted on his body.

In addition to the risk from external circumstances that can affect individual components of the equipment, the diver is likewise endangered from simply becoming tired when diving with this equipment. Since a pump movement is required for virtually each breath, diving in this way can be very strenuous. Even at a depth of a few meters, each breath is accompanied by the exertion of a knee bend such as would be executed on land. At greater depths, movement is comparable to a knee bend on land with added weights. Without knowledge of the relevant physical relationships, the normal user easily underestimates this exertion and risk. To make matters worse, there is also a rise in the oxygen requirement with increasing effort. If, for example, the diver does not know that the physical effort for providing the fresh air increases with increasing depth, it can easily happen that the user will gain depth in a brief moment of rest and no longer be capable of carrying out the next pumping movement. As a rule, the diver will just have breathed out in this phase, and so will easily panic. In conjunction with the equipment fastened on his body, there is an increase in the risk of a panic reaction, the more so since carrying out a swimming movement is greatly impaired. Should the diver manage nonetheless to force his way to the surface for safety, he will be completely exhausted. Possibly is lacking in the even the strength to hold on for a relatively long time to the float, mostly a signal buoy.

A further disadvantage of the equipment already known is that the pump is connected to a limb that actuates the pump. The pump is normally actuated via a leg movement, the feet being arranged in stirrups. However, the feet can easily slip from these stirrups during bending of the legs. The consequence is failure of the oxygen supply. In such a situation, reapplying the stirrups to the feet is virtually ruled out, because the diver is firstly no longer getting air and, secondly, is hampered by the fresh air tank, which is located on the chest, as a rule.

Numerous risks proceed from the already known diving apparatus operated by muscular force. A widespread use of this diving technique has so far been opposed by the severe safety shortcomings.

SUMMARY OF THE INVENTION

The disadvantages of the prior art resulted in developing the diving apparatus of the type mentioned at the beginning to the effect that diving with such an apparatus gains substantially in safety and the user is capable of reacting appropriately to unforeseen circumstances.

In order to achieve the object, the invention proposes, starting from the diving apparatus of the type mentioned at the beginning, that the diving weights are detachably fastened, for example via surface zip fasteners, on the fresh air tank, and can therefore be removed easily. Furthermore, it is the subject matter of the invention that the pulling means between the pump and the limb on which it is fastened has a quick release device which permits easy separation of the pulling means. Furthermore, it is proposed that the float is surrounded by a net which permits the diver to hold on to the float. In addition to the abovementioned developments, it is likewise the subject matter of the invention that the float has a seat arranged below the water surface. It is proposed, furthermore, that the belts by means of which the fresh air tank is fastened on the diver in each case have at least one quick fastener which can easily be opened by the diver.

A particular advantage of the inventive fastening of the diving weights by means of surface zip fasteners on the fresh air tank resides in the ease with which these diving weights can be removed. Should the diver get into a dangerous situation necessitating rapid ascent, he can remove the diving weights by a simple reflex action of ripping them off the fresh air tank and, thereby rendered lighter, can safely reach the maturing surface, possibly with the aid of the buoyancy of the residual air still present in the fresh air tank. The surface zip fastener is particularly well suited to such a connection, since it ensures a virtually uninterruptedly firm connection independently of the ambient medium. The diving weights are reliably held both during transport of the diving apparatus on land and when it is being used in the water. Despite the enormous load-bearing capacity of the connection with a surface zip fastener, introducing force at the edge of the surface zip fastener connection suffices to cancel the adhesion. The originally two-dimensionally distributed load is concentrated during the release operation onto a narrow line, and this ensures that any person is capable of dumping the diving weights irrespective of individual bodily strength.

A further advantage of the diving apparatus according to the invention resides in the fact that the diver is easily divested of the pulling means fitted on a limb and by means of which the pump is actuated. In the case of a suddenly occurring dangerous situation, the user can actuate the quick release device and thus sever the connection between the fastening on the actuating limb and the pump. Any panic in the user is thus avoided, and he is able to swim up without hindrance to the surface for safety. It is advantageous to make use for the quick fastener of clamping fasteners with which the possibility of gripping the clamping lever is easily accessible.

In order to counter a safety risk from exhaustion of the diver, according to the invention the float is surrounded by a net which permits the diver to hold on to the float. It is easily possible according to the invention to hold on to the float while saving strength without the need for changing the floats already on the market, which take the form of buoys, or signal buoys. On the one hand, a net tensioned around the float permits a desired grip for the buoyancy means, and on the other hand conventional buoys and appropriate nets can be procured easily and inexpensively.

The safety of such a diving apparatus can also be increased by a seat arranged on the float below the water surface. If the diver is exhausted from an extended dive or because he has just experienced a strenuous dangerous situation, he can rest while comfortably seated on the float. The diver is thus able to regather his strength and return to the shore by swimming.

A further possibility of increasing the safety of such a diving apparatus results when the belts by means of which the fresh air tank is fastened on the diver can be easily opened by the diver by actuating quick fasteners respectively arranged on the belts, particularly when the diving weights are fitted on the fresh air tank, the diver is capable of instantly freeing himself both from the fresh air tank and from the diving weights. Becoming free from the fresh air tank means that the latter no longer impedes swimming, and the diver can surface for safety under his own power. The risk of panic, and thus of uncontrolled reactions, is substantially reduced by knowing it is possible to free oneself quickly from the main component of the diving apparatus.

One advantageous development of the invention provides that the diving weights are containers or bags which can be filled with ballast materials.

Such diving weights are of variable mass and allow the diver to undertake adjustments and counterbalancing operations even during the dive. However, diving is frequently associated with travelling, in particular flying, the transportation of s lead weights being preferably avoided. Given the fillable diving weights according to the invention, the desired downward force can be produced with little outlay with the aid of a filling by using, for example, sand, which is mostly present at the dive site.

The use of such diving weights becomes particularly advantageous when there is present at these containers or bags an additional compartment in which the diver can, appropriately, bring along objects. These can be, for example, diving knives, photographic equipment, or even possibly lifesaving signaling means. Objects found during the dive can advantageously be stowed in the additional compartment. The diver's hands remain free at all times in order to contribute to forward motion and stabilization of attitude in the water.

It is provided in a further refinement that the fresh air tank has flaps, fitted like wings, which are provided with surface zip fasteners and can be fixed via corresponding surface zip fasteners on the fresh air tank, it being possible to fix the diving apparatus on the fresh air tank by means of the surface zip fasteners which are located on the flaps. The connection between fresh air tank and diving weight is particularly capable of being loaded in this way since the area of the surface zip fastener is extended by the area of the wings that can be folded out. It is possible, furthermore, to render the surface zip fasteners ineffective simply by applying the wing-like flaps and thus to avoid contact with the sometimes very rough surface of surface zip fasteners during the dive. Moreover, soiling of the unused surface zip fasteners in the case of separated diving weights is avoided, since the latter are protected by the wing-like flaps. The service life of the surface zip fasteners is extended in this way, and the full effect of the connection is maintained in the long term.

In order to obtain a particularly firm connection between fresh air tank and diving weights, it is expedient to make use for fastening the diving weights both of the surface at the wing-like flaps and of the surface zip fasteners on the fresh air tank, which correspond to the surface zip fasteners on the flaps. As a result, there is always a reliable connection between fresh air tank and diving weights even in the case of very heavy diving weights, including when out of the water.

In order that the limbs which actuate the pump of the diving apparatus cannot inadvertently lose the connection to the pulling means, it is expedient to fasten the pulling means on the pulling limb. Such a fastening can be performed advantageously in a force-closed fashion, for example by applying around the middle region of a foot a belt previously requiring to be adjusted tightly, or in a self-closed fashion, by applying a strap both around the ankle and around the middle region of the foot. A combination of the two possibilities is also conceivable.

It is expedient in a further refinement of the diving apparatus according to the invention when the seat fitted on the float is formed from a strap fastened on the float and from an elongated seating element extending through this strap. Since a large proportion of the weight force of the user is cancelled by the buoyancy of the water, such a seat need be designed neither to be particularly comfortable nor particularly stable. This means that the simple proposed seating arrangement, which can be produced cost-effectively, is easy to dismantle and can be transported advantageously is particularly advantageous.

In order further to reduce the number of items of equipment to be brought along, it is expedient when the elongated seating element is formed by a snorkel. A snorkel belongs to the basic items of equipment of each and every diver and is therefore regularly carried along.

In order for the diver always to have his hands free when staying on the surface of the water at the float, for example in order to don the equipment or to check the correct seat, it is expedient to fit the float with a strap or a hook on which the diver can fasten his upper body. Staying at the float is less tiring in this way for the diver. This saving of energy can be life-saving, particularly in an emergency situation.

In order to be able to free oneself from the diving apparatus as quickly as possible under water, it is advantageous when the fresh air tank is fastened on the front of the torso of the diver by means of two belts which are led over the back and in each case have a quick fastener. It is expedient in this case to arrange the quick fasteners in the region of the lower ribs, since they hardly cause any disturbance there and can always be reached by the user without a problem.

It is expedient in this case to use plug-in buckles for the quick fasteners, since such buckles instantaneously and mostly automatically release the barb from the receptacles in which they latch when plugging together is performed. Folding buckles, which clamp in the belt to be fastened are less suitable for this purpose, since after the release the free pulling means end must firstly be pulled through the buckle before the diver is freed from the diving apparatus.

In order to adapt the diving apparatus to different body sizes, it is particularly advantageous when, for the purpose of fastening the fresh air tank, the length of the belts can be adjusted and the sections of the belts which are provided with quick fasteners can vary in position along the belts preferably via three bar buckles fitted on both sides of the quick fasteners. Optimal positioning of the quick fasteners permits fitting at a location with optimum accessibility for the user, and prevents the hard quick fasteners from causing pressure points on the body.

In order further to enhance the safety of the diving apparatus according to the invention, it is advantageous when there is fitted on the fresh air line a shortening belt which permits the line length not required for the current diving depth to be fastened in loops on the remaining fresh air line. A long, freely hanging fresh air line increases the risk of damage to the same or of kinking, possibly even of being ripped off. In order to counter these risks, according to the invention the freely hanging length of the fresh air line is limited to the required length.

Because changing the diving depth requires a variation in the freely hanging fresh air line length, it is advantageous when the shortening belt has at one end a three bar buckle through which the other end is guided, and is fitted on the fresh air line merely by circumferential clamping as a consequence of pulling the shortening belt tight around the fresh air line, if appropriate including the loops of excess length of fresh air line, there being located near the end of the shortening belt at which the three bar buckle is fitted a handgrip which enables the user to exert a counterforce on the three bar buckle while pulling the shortening belt tight. Since the shortening of the fresh air line length takes place under water, the working conditions for this operation are rendered substantially more difficult. For this reason, according to the invention the shortening belt is equipped with a handgrip for producing a counterforce against the frictional force which is produced by pulling the shortening belt through the three bar buckle.

An abutment, fitted directly on the shortening belt, of a size which is suitable for one or two fingers, preferably for the thumb, has proved to be particularly ergonomic.

Since the load on the diver from the diving apparatus according to the invention becomes greater with increasing depth, it is expedient when the pulling means on the pump is guided in such a way via deflecting rollers on the pump and on the pulling limb that through a force transmission ratio other than 1, in particular less than 1, results. This opens up the possibility for the diver of also exploring greater depths with the diving apparatus according to the invention. In a way similar to the case of a bicycle transmission, the diver must now execute more pumping movements for the same fresh air volume. It is expedient to design the diving apparatus according to the invention with a transmission for dives in shallow waters.

One advantageous development of the invention provides that the buoyancy of the expired air is used to convey a portion of the required fresh air. On the one hand, it is possible in this way to dive at greater depths with the diving apparatus according to the invention, while on the other hand the diver does not tire so quickly through the pumping operation. In addition, the safety of the diving apparatus is enhanced, since when the pumping movement is missed out the diver always obtains an amount (if reduced) of fresh air through breathing out.

In order to use the buoyancy of the expired air, it is expedient that there is led from the diver to the float at the water surface a further line via which the expired air of the diver is conducted to the air atmosphere. The pressure difference in this line between the air atmosphere at the water surface and the expired air of the diver can be used at any desired point to convey the fresh air. Furthermore, the air bubbles which are always disturbing when diving are eliminated, and so the observation of the underwater world is substantially less disturbed.

If the equipment which converts the buoyancy of the expired air into a pumping action for fresh air is arranged at the diver, it is expedient when the pressure of the air atmosphere is present in the line for the expired air.

The pressure difference between expired air and air atmosphere is used with particular advantage when a fresh air pump is driven by means of this pressure difference.

A particularly harmonious and uniform supply of the fresh air results when the fresh air delivery pump is driven via a rotary machine, in particular a rotary piston machine or a cellular wheel. Breathing out via the driving rotary machine can be performed largely free from pulsation. The transmission ratio between rotary machine and fresh air delivery pump should be selected such that virtually no resistance is to be detected when breathing out. This effect can also be achieved by adaptation of the delivery volumes of the fresh air delivery pump and the rotary machine per revolution.

In order for it always to be possible to additionally deliver fresh air without the occurrence of suction in the expired air line, it is expedient when the drive from the expired air is connected to the fresh air pump by a coupling in such a way that only torques from the drive to the fresh air pump can be transmitted in the center of rotation provided.

One advantageous embodiment of the invention provides that the fresh air tank has on the top side, or the fastening belts connected thereto have in the upper back region, a central handgrip at which the diver can, if required, be pulled out of the water. Particularly as regards training with the diving apparatus according to the invention, it can be a great relief for the trainee when he experiences appropriate backup upon leaving the water. Furthermore, such a handgrip is of great help in rescuing injured or exhausted divers.

In order to enhance diving comfort, it is advantageous when the fastening belts of the fresh air tank have in the region of nape and shoulder pads which are preferably fastened on the belts by means of adhesive bonding. These pads can expediently be produced from foamed rubber.

Particularly in the shoulder and nape regions, high loads occur during the pumping operation which in the event of a shoulder belt without padding can easily have the effect of chafing the skin.

One advantageous development of the diving apparatus provides that the belts for fastening the fresh air tank on the diver have in the back region pads which are preferably fitted on the belts by means of surface zip fasteners. These pads can surround the belts like a flexible tube and expediently be produced from foamed rubber. A design of the pads like a flexible tube is especially advantageous, in particular, when these pads are not fastened directly on the belts, but the shape of the flexible tube is not produced until being laid around the belt by means of a surface zip fastener extending in the longitudinal direction at the edge of the originally flat pad. It is thereby possible for the belt to be adjusted in the padded region, as well.

It is preferred that the fresh air tank is connected to the container via a material element which surrounds the fresh air tank. In this case, the material element can be equipped with a pile strip which runs along the fresh air tank and with flaps which are laid with pile strips, and the container in each case can have touch-and-close strips assigned to the pile strips. The result is that the container is connected to the material element only at three points, and this permits a fastening of the container to diving weights which is reliable, but can easily be released manually.

The material element can have a plug-in strap under which a section of the pile strip runs and into which it is possible to push a plug-in tab which has a touch-and-close trimming facing the section of the pile strip. This avoids undesired detachment of the container from the material element.

For a particularly reliable fastening, the flaps of the material element can engage on both sides with holders which are fastened on the container.

In order to compensate the effect of the diving weight located in the container in the case of this exemplary embodiment, for the purpose of introducing air the fresh air tank can optionally be connected to a buoyancy body.

The invention is explained below with the aid of exemplary embodiments and with reference to the accompanying drawings.

DESCRIPTION OF THE PREFERRED EMBODIMENTS

Figure 1:
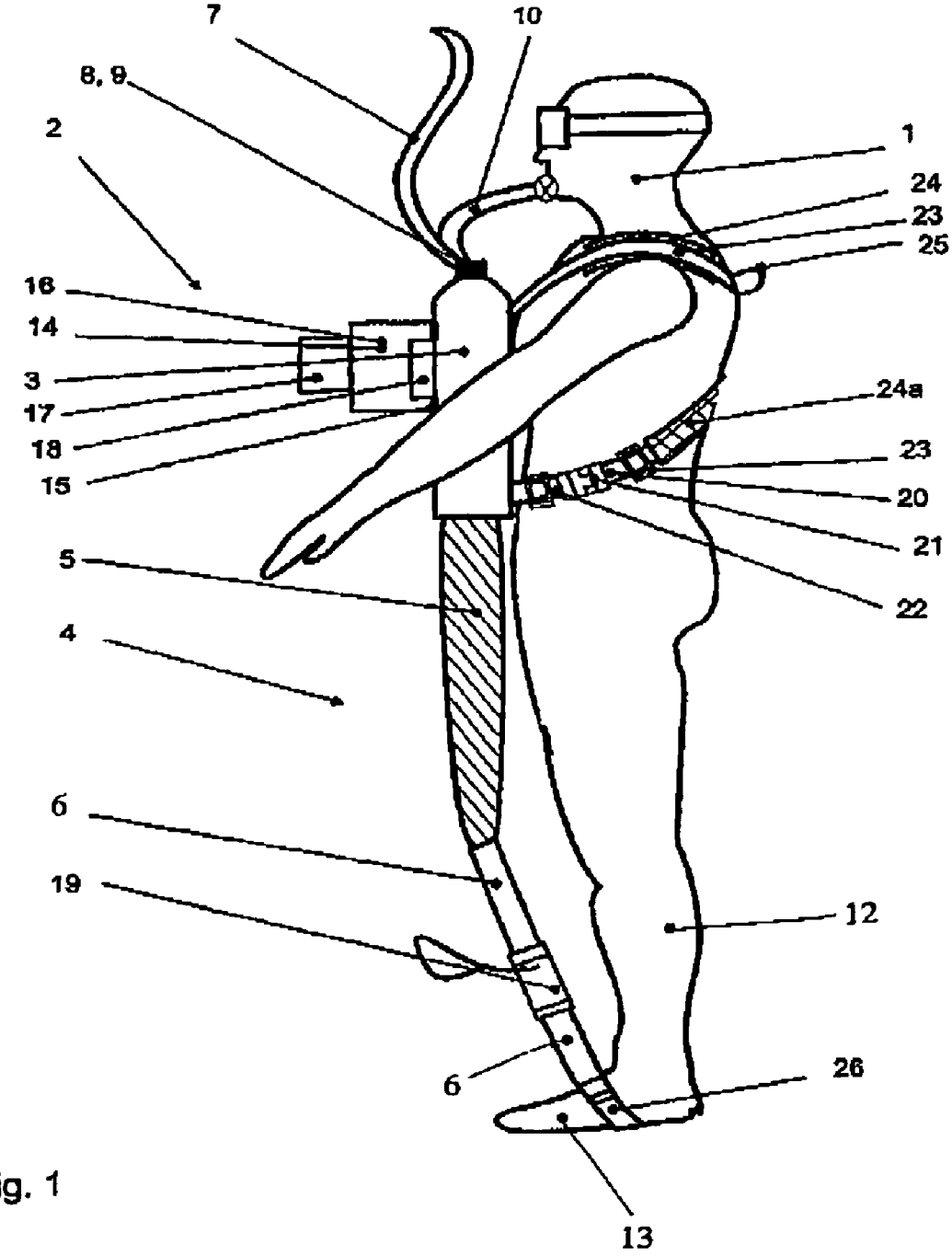
FIG. 1 shows a diver with the diving apparatus according to the invention, in side view.
Figure 2:
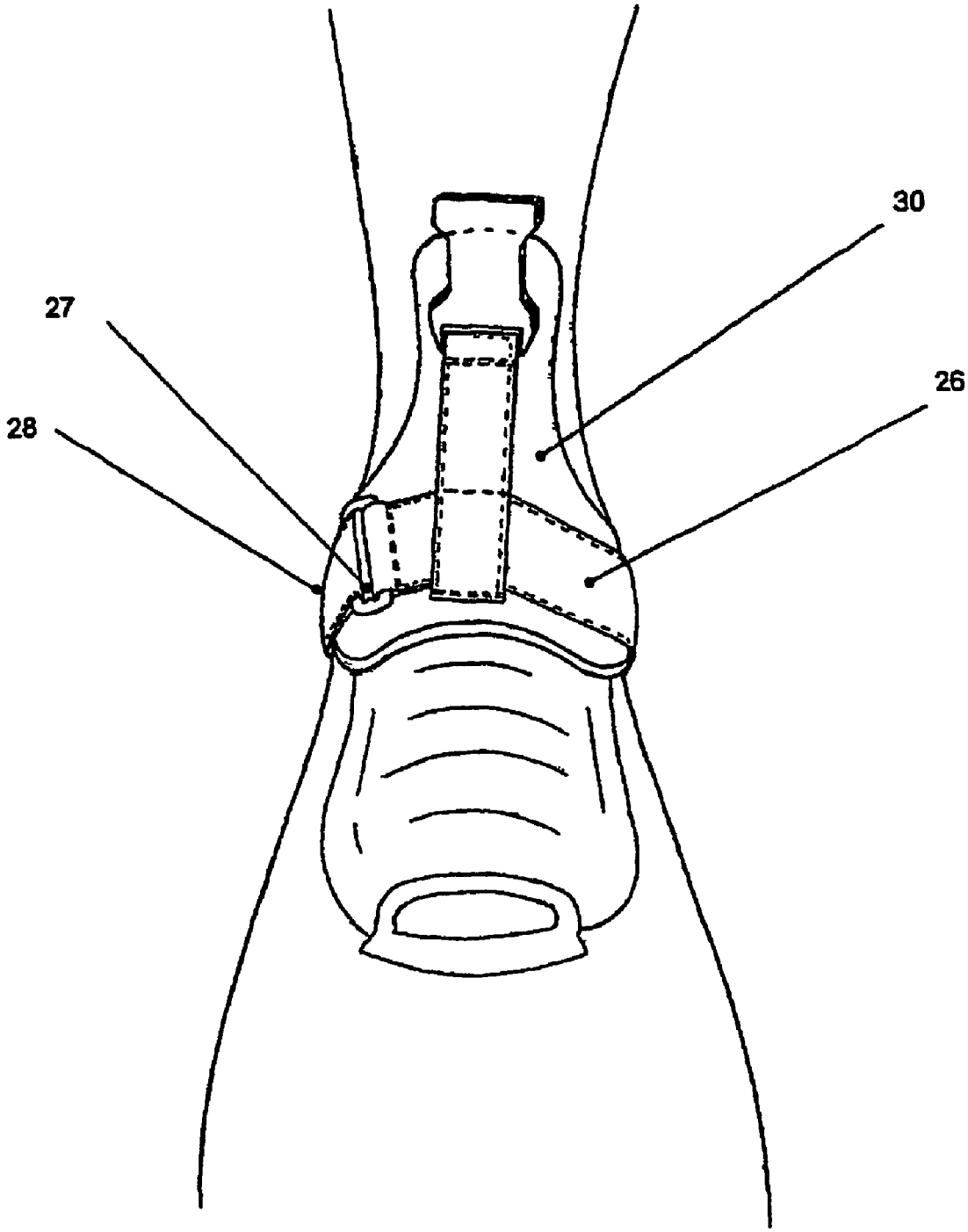
FIGS. 2 and 3 show respectively a perspective view of an inventive fastening of the pulling means on a foot with fin.
Figure 3:
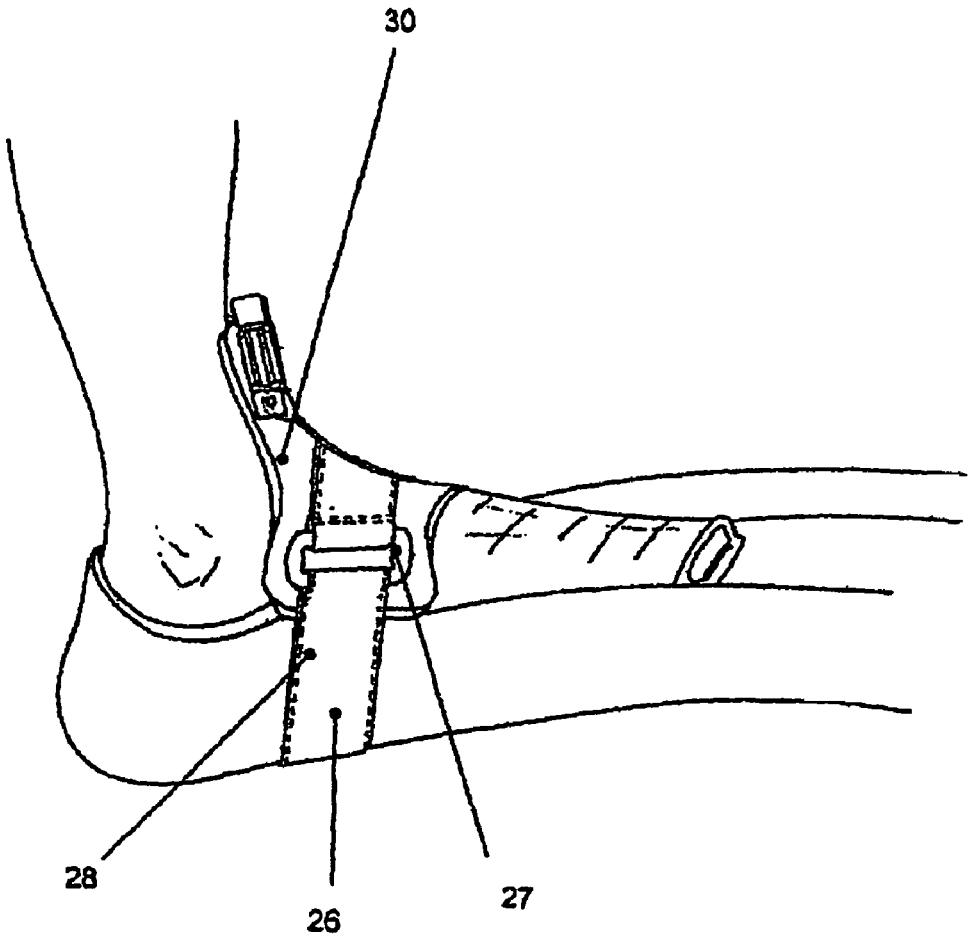
Figure 4:
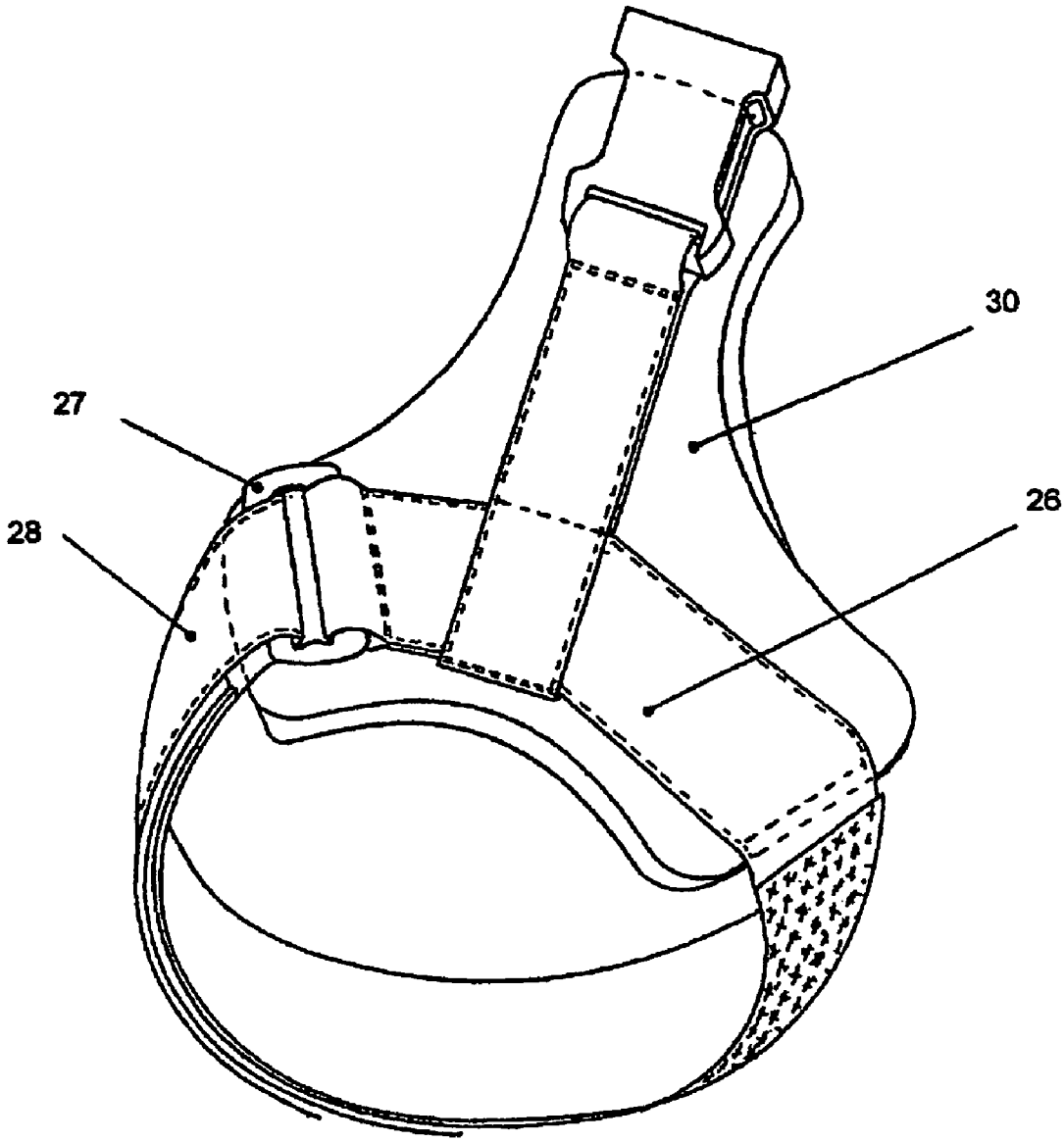
FIGS. 4 and 5 show respectively a perspective view of a fastening of the pulling means for a foot.
Figure 5:
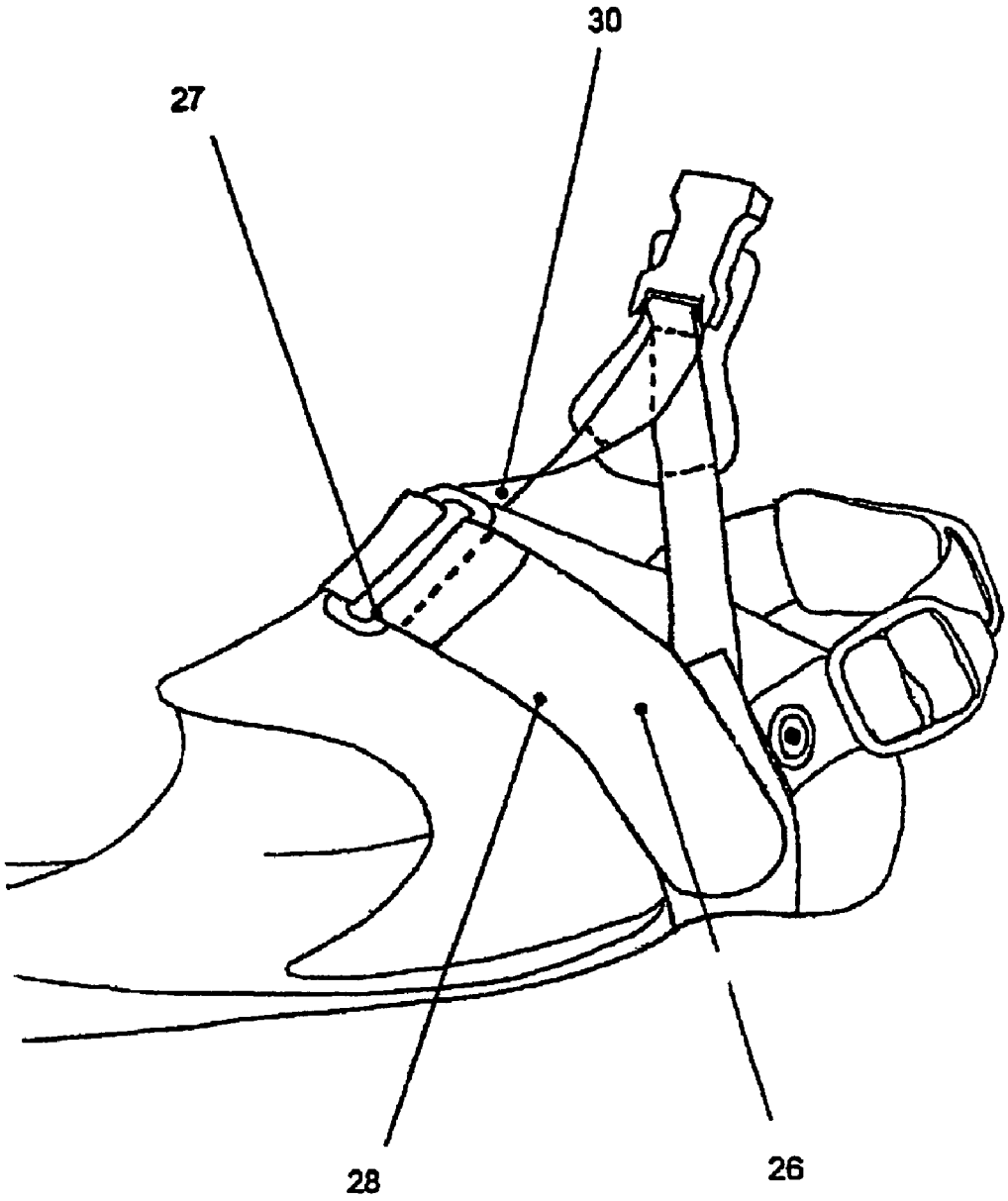

As a rule, the diver 1 wears the diving apparatus 2 according to the invention on his breast. The diving apparatus 2 comprises a fresh air tank 3 with a pump 4 in the form of an elastic hollow body 5 which is pulled out by the diver 1 via a pulling means 6 in order always to pump the fresh air from the fresh air tank 3.

The fresh air is supplied via a fresh air line 7 which is connected to the fresh air tank 3 via a first valve 8. The first valve 8 prevents backflow of the fresh air to the air atmosphere. Via a second valve 9, the diver 1 is able to breath in the fresh air located in the fresh air tank 3 through the breathing air line 10 and the mouthpiece 11.

The pump 4 is actuated by the legs 12, the pulling means 6 being fitted on the foot 13 by means of a fastening. Diving weights 14 are fitted on the fresh air tank 3 via surface zip fasteners 15. These diving weights are containers 16 which are preferably to be filled with sand. Located next to the diving weights 14 on the fresh air tank is an additional compartment 17, which the diver 1 can use for transporting and keeping objects safe. Next to the surface zip fasteners 15, which are fitted directly on the fresh air tank 3, the diving weights 14 can additionally be fastened with the aid of surface zip fasteners via flaps 18 fitted like wings.

Located on the pulling means 6 is a quick-release device 19 which permits a quick release from the connection to the diving apparatus 2. The belts 20, which fasten the fresh air tank 3 to the torso of the diver 1, likewise have quick fasteners 21 in the region of the lower ribs of the diver 1 These quick fasteners 21 are designed here as plug-in buckles. In order for the quick fasteners 21 always to have an optimal position on the body of the diver 1, their position can be adjusted by two three-bar buckles 22, 23 on the torso of the diver.

Located respectively in the nape and shoulder regions of the belts 20 is a pad 24 made from foamed rubber. This pad 24 is bonded on the belts on the side facing the diver 1. In the back region, two further pads 24*a* are applied like a flexible tube around the belts 20 by means of surface zip fasteners extending in the longitudinal direction at the edge of the originally two-dimensional pads 24*a*.

Arranged in the upper back region of the diver 1 is a central handgrip 25 which enables the diver 1 to be pulled from the water.

So that the fastening of the pulling means 6 cannot slip from the foot 13, the invention provides a force-closed connecting means of a gripping belt 26. The length of the belt 26 can be set via a two bar buckle 27, and the belt can be fixed by means of a surface zip fastener 28. The fastening has a pad made from foamed rubber 30 in the region of the instep 29.

Figure 6:
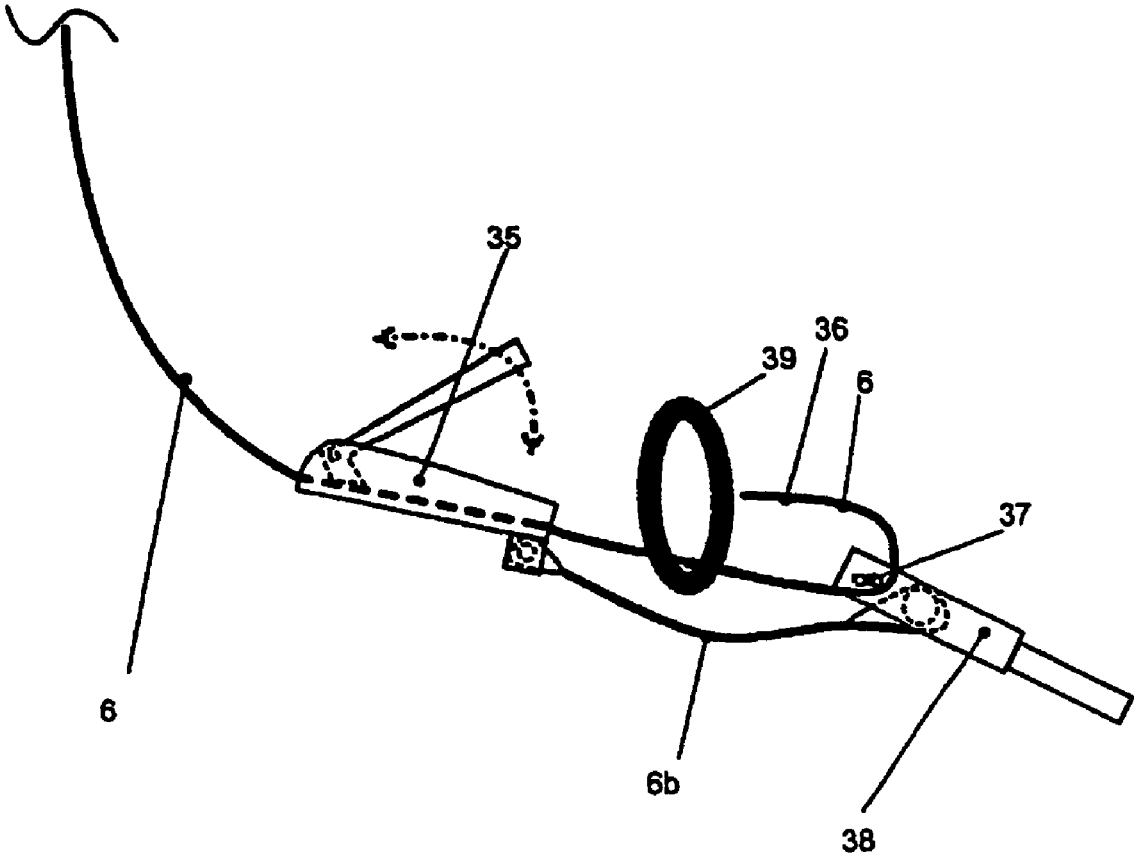
FIG. 6 shows a quick release device of the pulling means.

FIG. 6 shows a part of the pulling means 6 with a quick release device 19 for separating the pulling means 6. The pulling means 6 is interrupted and terminates at a free end 36. The free end 36 is plugged through a folding buckle 35 and clamped there during operation. The folding buckle 35 is connected via a connecting piece 6*b* to a plug-in buckle 38 which is fitted during operation of the pump 4 on a foot by means of a corresponding matching piece (not illustrated) on a fastening device. The free end 36 of the pulling means 6 is subsequently led to the folding buckle 35 through a ring 39 and around a web 37 on the plug-in buckle 38. If the diver pulls on the ring 39, which is designed as a handgrip, the folding buckle 35 opens, the pull on the pulling means 6 is eliminated, and the free end 36, applied around the web 37, of the pulling means 6 comes loose, since the braking action of the tensioned connecting piece 6*b* is likewise eliminated. During operation, the free end 36 supports the transmission of the pulling forces, and in the case of the freeing from the pulling means 6 and the pump 4 connected thereto the folding buckle 35 is opened via the free end 36 of the pulling means 6. Inadvertent loosening of the folding buckle 35 is excluded in this way. The ring 39 is designed to be buoyant in the water so that it is always easy to grasp.

Figure 7:
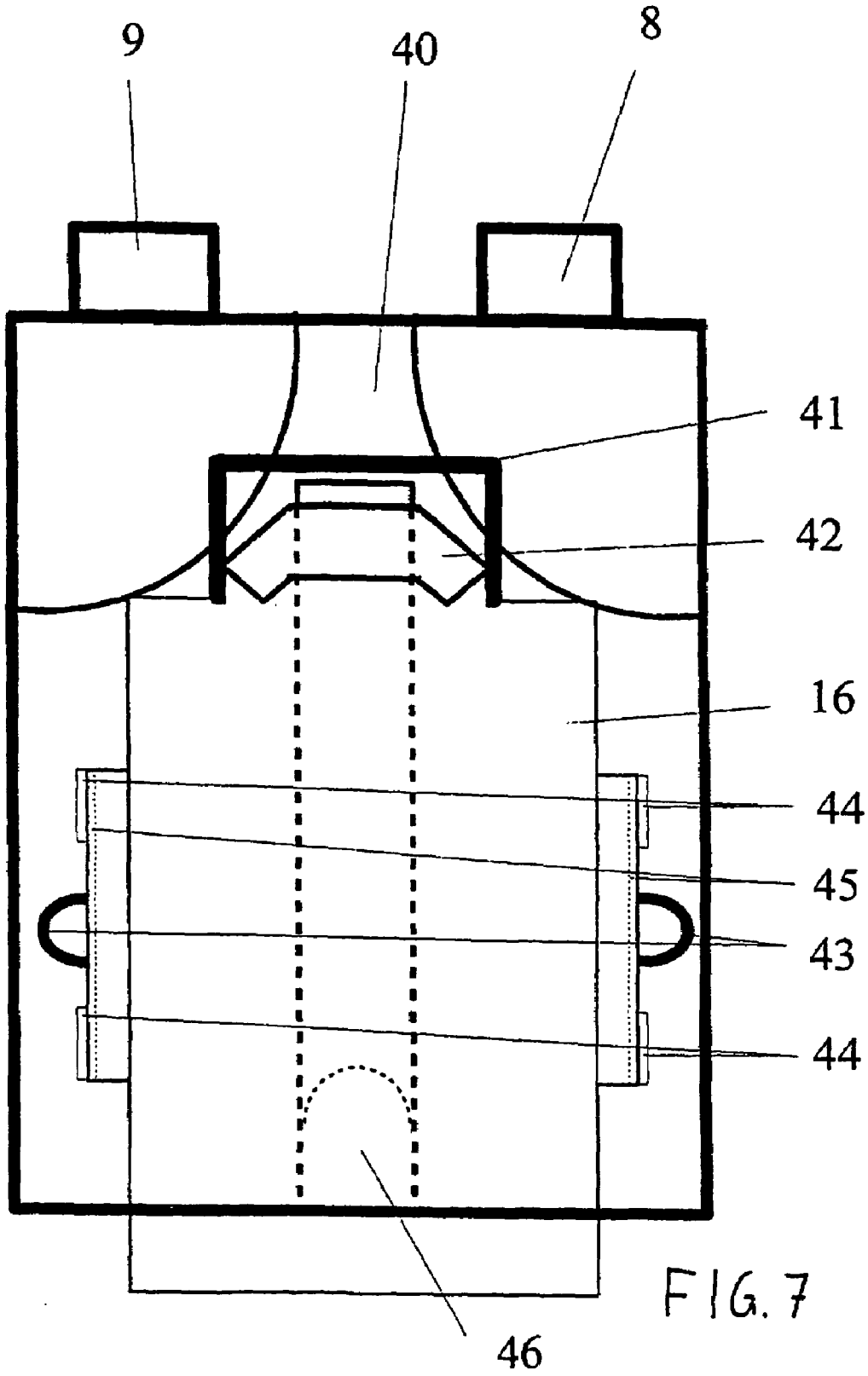
FIG. 7 shows a plan view of a container which is fastened on a fresh air tank and contains diving weights.

FIG. 7 shows a plan view of the fresh air tank 3, which is essentially spanned by a material element 40 which is fastened on the fresh air tank 3. The container 16, which serves to accommodate a diving weight, for example 25 kg of sand, is fastened on the fresh air tank 3 via the material element 40.

A plurality of pile/touch-and-close connections serve to fasten the container 16 on the material element 40. In this regard, there is sewn centrally onto the material element 40 along the fresh air tank 3 a pile strip 40*a* which is assigned a touch-and-close strip 48 on the container 16.

Provided on the end of the pile strip 40*a* facing the valves 8, 9 is a plug-in strap 42*a*, sewed on at the material element 40, for accommodating a plug-in tab 42 which projects from the container 16, is sewed on at the latter and is provided with a section of a touch-and-close strip 48. The section of the touch-and-close strip 48 is sewn onto a material strip 49 which is sewed on at the material container 16. A dump handgrip 41 at the upper end of the container 16 permits loosening of the connection between the touch-and-close strip 48 and the pile strip 40*a*.

Figure 8:
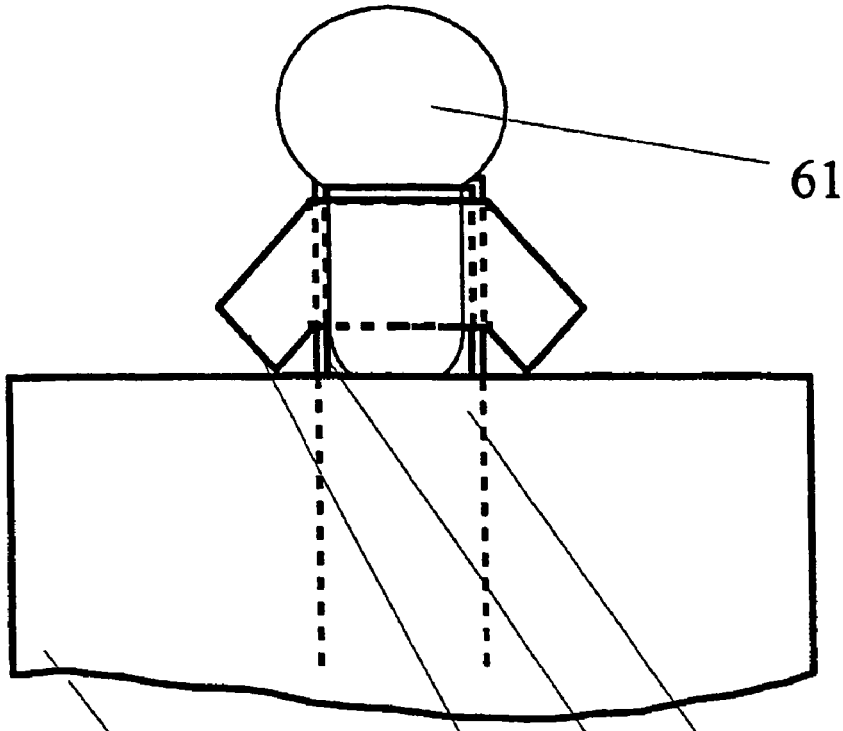
FIGS. 8, 8*a* show respectively a plan view and a sectional view of a detail of FIG. 7, FIGS. 9, 10 show respectively sectional views of another detail from FIG. 7.
Figure 8A:
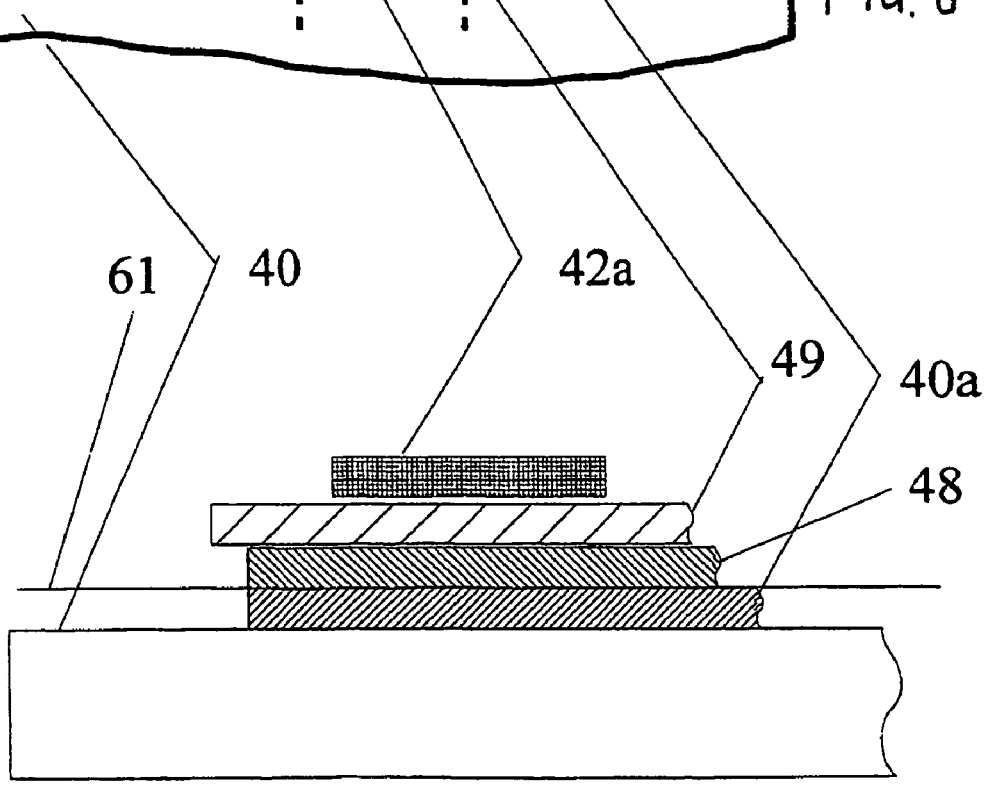

The design in the region of the plug-in tab 42 emerges from FIGS. 8, 8*a*. 61 denotes a key which is applied to a section of the pile strip 40*a* before the insertion of the plug-in tab 42, such that the section of the touch-and-close strip 48 can be pushed into the plug-in tab 42 without already coming into engagement prematurely, that is to say before reaching its end position in the plug-in tab 42, with the pile strip 40*a*. After reaching its end position, the key 61 is pulled out of the plug-in tab 42 such that the section of the touch-and-close strip 48 can come into engagement with the assigned section of the pile strip 40*a*.

Figure 11:
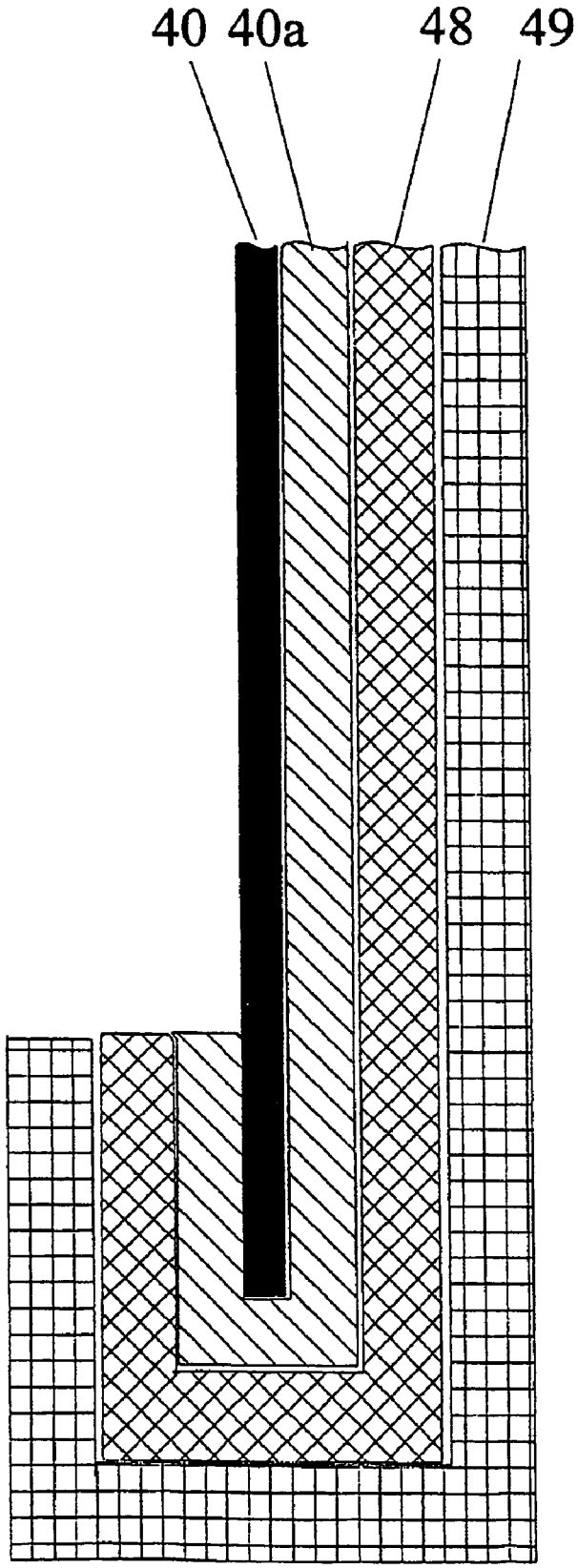
FIG. 11 shows a sectional view of a further detail from FIG. 7.

At the lower end of the fresh air tank 3, the pile strip 40*a* runs inward around an edge of the material element 40 and a short distance along its own course on the outside of the material element 40 (compare FIG. 11). A free end 46 of the touch-and-close strip 48 correspondingly likewise runs along the fresh air tank 3 and then around the edge of the material element 40, and is in engagement with the associated piece of the pile strip 40*a*. The touch-and-close strip 48 is therefore in engagement with the pile strip 40, starting from the plug-in tab 42 up to around the edge of the material element 40.

Figure 9:
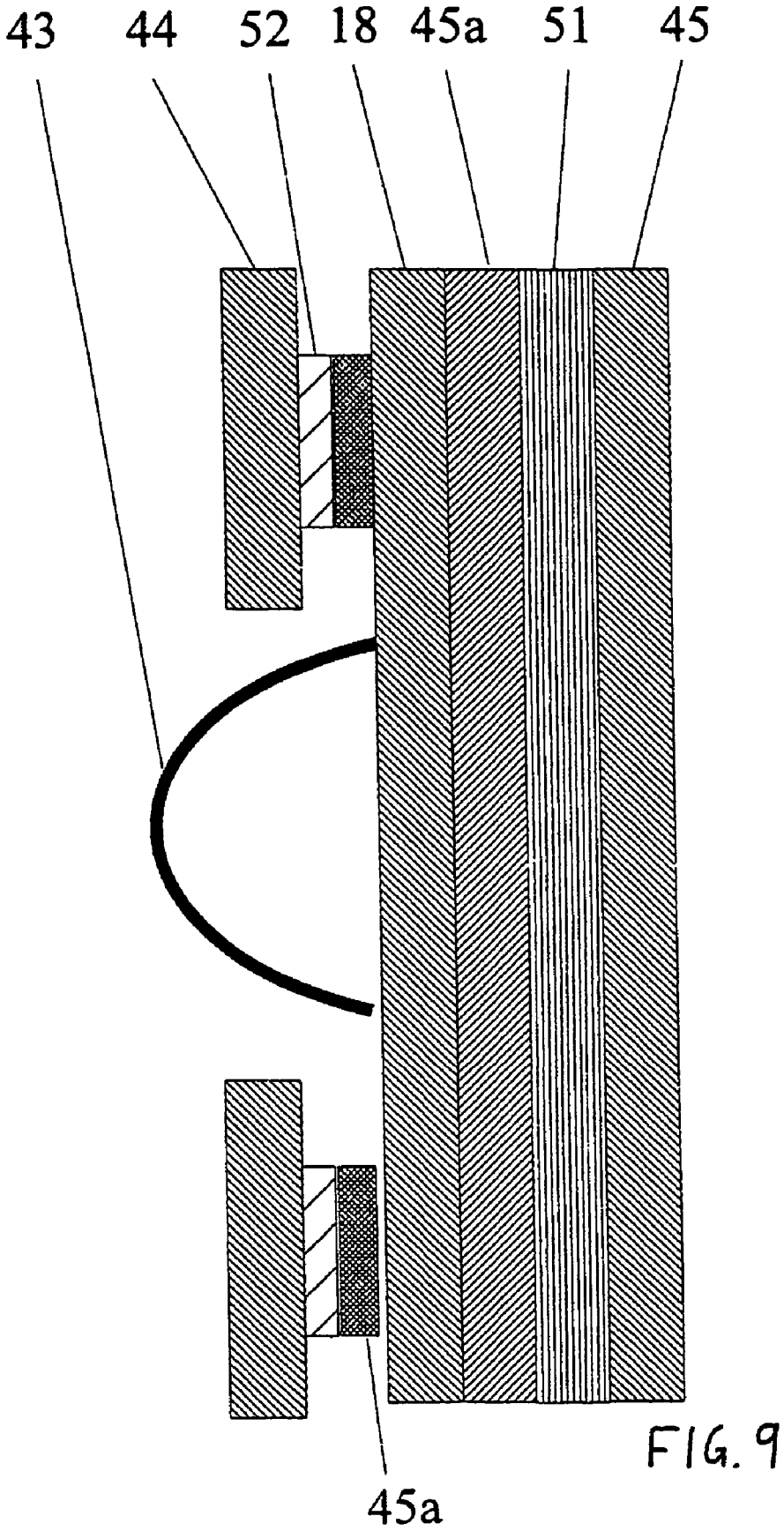

Moreover, there are sewed on at the material element 40 two wing-like flaps 18*a* which project from the material element 40 and are laid on both sides with pile strips 45*a* (compare FIG. 9). Provision is made both of external wing holders 44 and internal wing holders 45 which are sewed on in each case at the container 16 and grip one of the flaps 18*a* in pairs in each case. Here, the internal wing holders 45 run in each case over the entire width of the assigned flap 18*a*, while the external wing holders 44 are arranged in each case in two parts and at the edge of the relevant flap 18*a*. The wing holders 44, 45 are equipped in each case with touch-and-close strips 51, 52 for engaging with the pile strips 45*a* (compare FIGS. 7, 9, 10), the pile strips 45*a* running from the inside and outside in accordance with the touch-and-close strips 51, 52.

Figure 10:
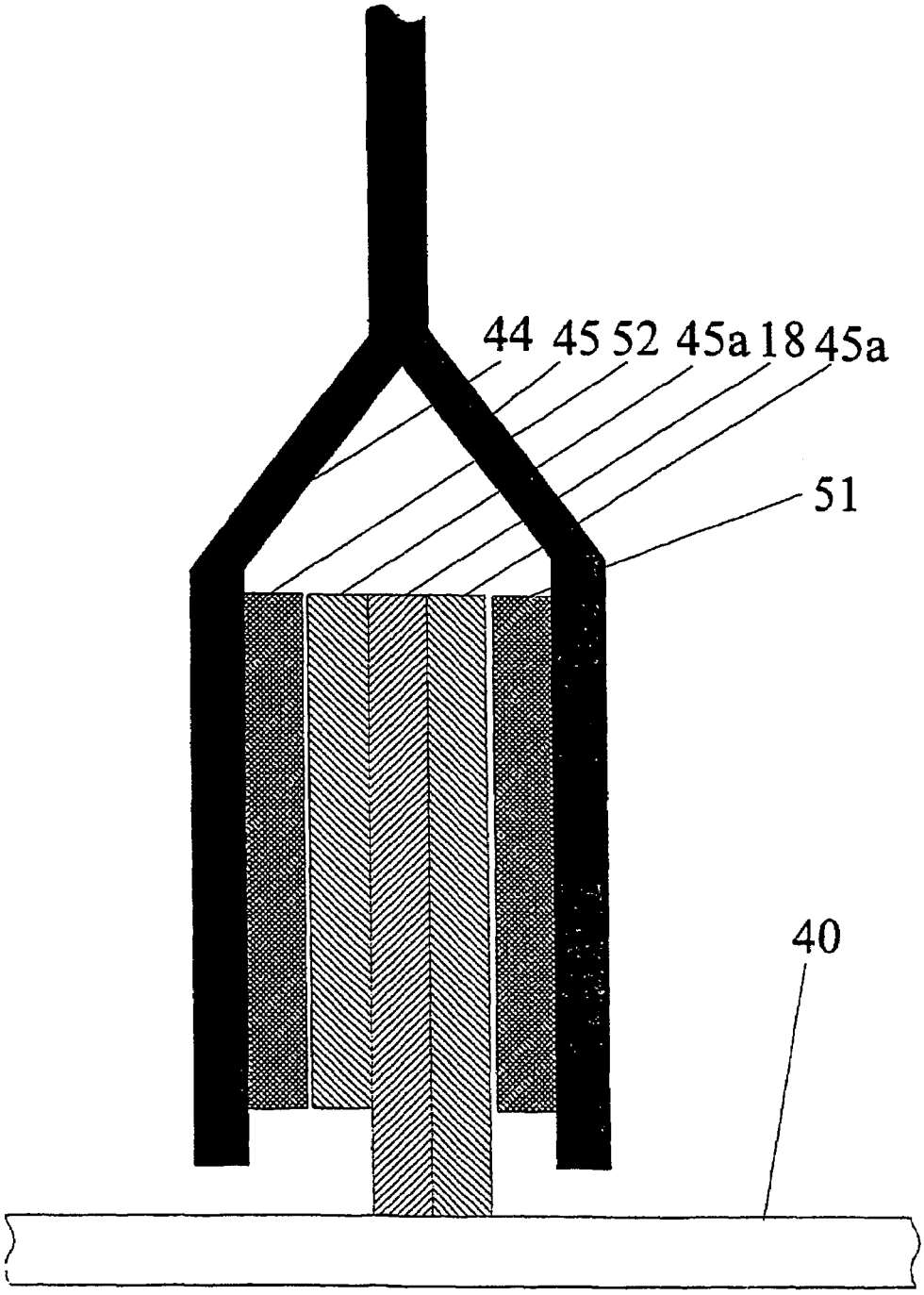

It follows from FIG. 10 that the internal and external wing holders 44, 45 are led together outside the flap 18. They are fastened on the container 16. The container 16 is thereby fitted on the material element 40 via a total of three pile/touch-and-close connecting units.

In order to loosen the connection between the container 16 and material element 40, D-rings 43, which are fitted in each case on the external wing holder 44 approximately in the middle of the respective pile/touch-and-close connection, are firstly actuated such that the pile/touch-and-close connections over the flaps 18 are loosened, and thus the complete loosening can be carried out simply and quickly by hand. The dump handgrip 41 on the container 16 is then actuated, and this loosens the connection between the pile strip 40*a* and the touch-and-close strip 48 in the region of the plug-in strap 42 such that the connection can be completely loosened by hand by pulling downward. These measures ensure that the container 16 with diving weights can be dumped quickly in an emergency.

Figure 12:
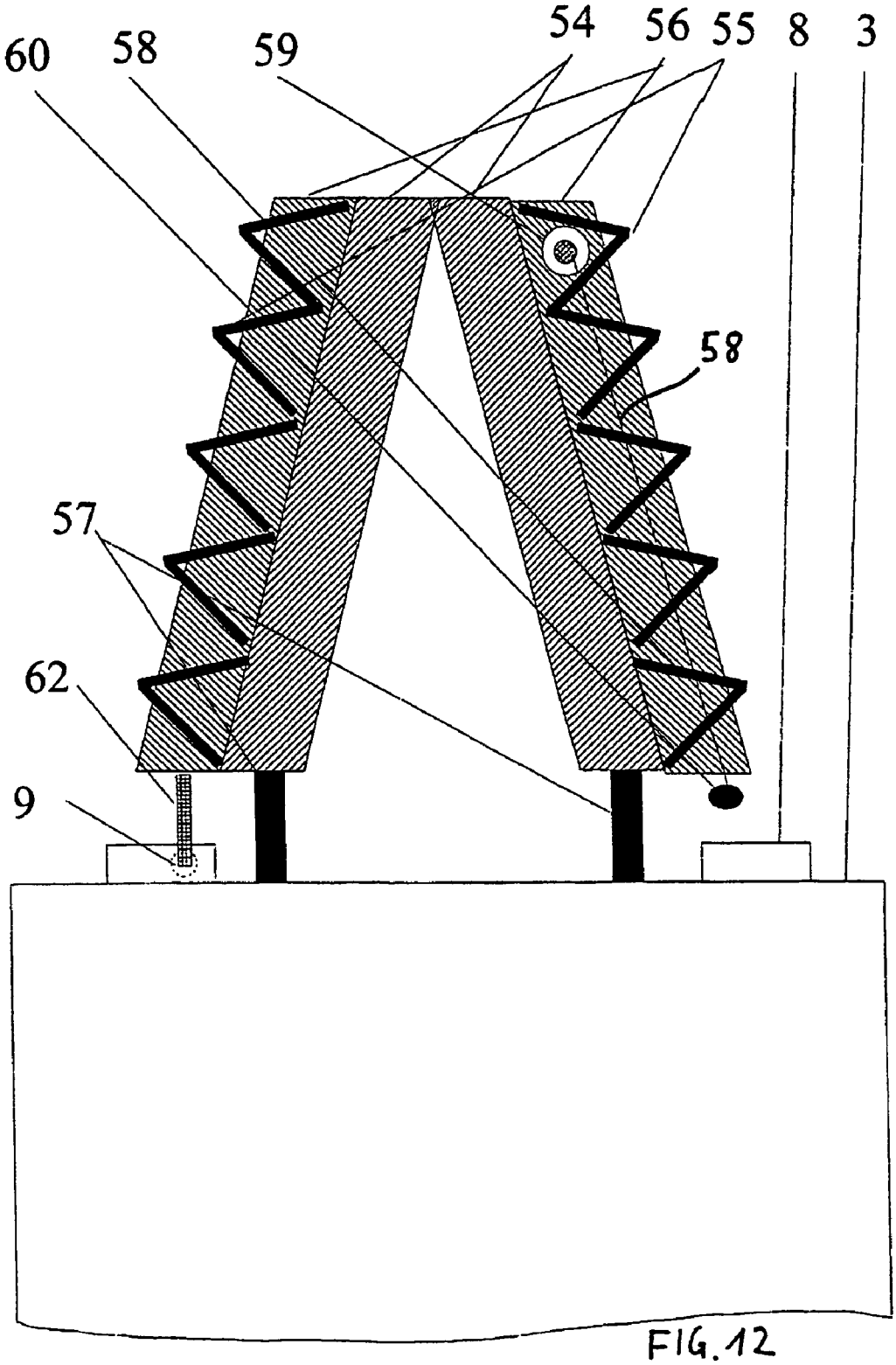
FIG. 12 shows a schematic view of a counterbalancing system for a diving apparatus.

With the aid of FIG. 12, a counterbalancing system will now be explained that can provide a buoyancy equilibrant which counteracts the downward force exerted by the diving weights. The diving weights ensure the required downward force so the diver 1 can acquire depth. However, the downward force increases with increasing depth by virtue of the fact that the volume of gases drops under rising pressure. The diver can now counteract this by filling a portion of his compressed air into a buoyancy body 56 from the fresh air tank 3 via a hose 62 which is led parallel to a nape belt 54 fitted over fastening belts 57, on the fresh air tank 3, and is held by a pressure rubber 55. The inhalation and exhalation valve 9 is extended by a hose connection and a mechanism which removes a portion of the self-produced compressed air.

The diver presses on a button on the housing of the valve 9. This button moves a quarter sphere in front of the inhalation stream. A portion of this air now passes outward to the valve housing wall through a tube which is located in the axis which moves the quarter sphere.

There, the air is tapped via the connected hose 62. A simpler variant is to fit a hose connection to the top side of the tank. Screwed into this hose connection is a one-way valve which is opened and closed by a pushbutton.

The diver thereby counterbalances the downward force which rises with increasing depth. If the diver now ascends, the buoyancy rises again.

In order to counteract this, there is located at the highest point of the diver, specifically at nape height, an outlet valve 59 which is operated by a rip cord 58. As long as the diver pulls on an operating button 60 of the outlet valve 59 and thus actuates the rip cord 58, the valve 59 is opened and air can escape into the water. The buoyancy drops and the diver stabilizes his diving position in this way.

The invention claimed is:

1. A diving apparatus for supplying a diver with breathing air comprising:

a fresh air tank which can be carried and fastened on the body of the diver, a fresh air line leading from the air atmosphere to the fresh air tank, a pump actuated by muscular force of the diver whereby the diver conveys fresh air via the fresh air line into the fresh air tank, a first valve in the fresh air line between the fresh air tank and the air atmosphere, which prevents backflow of the fresh air into the air atmosphere, a breathing air line connected with one end to the fresh air tank, a mouthpiece at the other end of the breathing air line, a second valve arranged on the breathing air line between the fresh air tank and the mouthpiece, at least one pulling means which is actuated at least with the diver's leg or the diver's arm and permits the actuation of the pump by the leg or arm movement, said pulling means being interrupted at least once between the pump and the limb on which the pulling means is fitted and has at the interruption a quick-release device which connects two portions of the pulling means at the interruption and permits a separation of the two portions;

said quick-release device having a folding buckle which is permanently fitted to one end of the pulling means and through which the other end, which is a free pulling end, extends and is fastened by a clamp, and diving weights which serve to compensate the buoyancy of the diver;

wherein the free pulling means end extends through the folding buckle and is laid through a handgrip and around a web fastened on an opposing piece of the pulling means such that if the diver pulls on the handgrip the folding buckle opens, the force on the pulling means is eliminated, and the free pulling means end around the web is loosened.

2. The diving apparatus as claimed in claim 1, wherein the diving weights comprise containers which can be filled with ballast materials, said attaching devices comprising surface zip fasteners.

3. The diving apparatus as claimed in claim 2, further comprising a compartment in which the diver can bring along objects is fitted on the container or bag.

4. The diving apparatus as claimed in claim 2, wherein the fresh air tank has flaps, fitted like wings, which are provided with surface zip fasteners and can be fixed on the fresh air tank via corresponding surface zip fasteners on the fresh air tank, it being possible to fix the diving weights on the fresh air tank by the surface zip fasteners which are located on the flaps.

5. The diving apparatus as claimed in claim 4, wherein the diving weights can be fixed on the fresh air tank both by the surface zip fasteners on the flaps and by the surface zip fasteners on the fresh air tank, which correspond to the surface zip fasteners on the flaps.

6. The diving apparatus as claimed in claim 2, wherein the fresh air tank is connected to the containers via a material element which surrounds the fresh air tank.

7. The diving apparatus as claimed in claim 6, wherein the material element is equipped with a pile strip which runs along the fresh air tank and with flaps which are laid with pile strips, and the container has touch-and-close strips assigned to the pile strips.

8. The diving apparatus as claimed in claim 1, wherein the pulling means includes a fastening device for fastening the pulling means on a pulling limb of the diver.

9. The diving apparatus as claimed in claim 8, wherein the fastening device includes a strap which can be shortened in a force-closed fashion to fasten the pulling means on the limb of the diver.

10. The diving apparatus as claimed claim 8, wherein the pulling limb is a pulling leg including a foot and the fastening device includes a first strap for surrounding the foot of the diver and a second strap for surrounding the ankle of the diver.

11. The diving apparatus as claimed in claim 2, wherein the containers are adapted for receiving sand.

12. The diving apparatus as claimed in claim 1, wherein the web is a part of a plug-in buckle which attaches a foot fastening device.

13. The diving apparatus as claimed in claim 1, further comprising diving belts for fastening the fresh air tank to the diver, the fresh air tank has on the top side, or the belts connected thereto have, for fastening on the diver in the upper back region, a central handgrip at which the diver can, if required, be pulled out of the water.

14. The diving apparatus as claimed in claim 13, wherein the belts for fastening the fresh air tank on the diver have in the region of the nape and shoulder pads which are fastened on the belts by adhesive bonding.

15. The diving apparatus as claimed in claim 13, wherein the belts for fastening the fresh air tank on the diver have in the back region pads which are fitted on the belts by surface zip fasteners.

16. The diving apparatus as claimed in claim 13, wherein the ends of the belts are guided through folding buckles, have rounded corners and are deburred.

* * * * *